US011304271B2

(12) United States Patent
Liu et al.

(10) Patent No.: US 11,304,271 B2
(45) Date of Patent: Apr. 12, 2022

(54) COMPOUND HEATING APPARATUS

(71) Applicant: Food Industry Research and Development Institute, Hsinchu (TW)

(72) Inventors: Feng-Chi Liu, Tainan (TW); Jia-Yan Hou, Tainan (TW); Binghuei-Barry Yang, Tainan (TW)

(73) Assignee: Food Industry Research and Development Institute, Hsinchu (TW)

( * ) Notice: Subject to any disclaimer, the term of this patent is extended or adjusted under 35 U.S.C. 154(b) by 0 days.

(21) Appl. No.: 17/069,147

(22) Filed: Oct. 13, 2020

(65) Prior Publication Data

US 2021/0112638 A1 Apr. 15, 2021

(30) Foreign Application Priority Data

Oct. 15, 2019 (TW) ..... 108137001

(51) Int. Cl.
*H05B 6/64* (2006.01)
*H05B 3/00* (2006.01)
(Continued)

(52) U.S. Cl.
CPC ..... *H05B 6/6485* (2013.01); *F24C 15/22* (2013.01); *F24C 15/322* (2013.01); *H05B 3/0076* (2013.01); *H05B 6/76* (2013.01)

(58) Field of Classification Search
CPC .. H05B 6/6402; H05B 6/6408; H05B 6/6414; H05B 6/642; H05B 6/6426; H05B 6/6435; H05B 6/6444; H05B 6/6447; H05B 6/647; H05B 6/6473; H05B 6/6476; H05B 6/6479; H05B 6/6482; H05B 6/6485;
(Continued)

(56) References Cited

U.S. PATENT DOCUMENTS 2,920,174 A * 1/1960 Haagensen ..... H05B 6/6402 219/685
6,153,867 A * 11/2000 Lee ..... H05B 6/6482 219/685
(Continued)

FOREIGN PATENT DOCUMENTS

CN 1608186 A 4/2005
CN 202958593 U 6/2013
(Continued)

OTHER PUBLICATIONS

Search Report appended to an Office Action, which was issued to Taiwanese counterpart application No. 108137001 by the TIPO on Apr. 8, 2020, with an English translation thereof.

*Primary Examiner* — Hung D Nguyen
(74) *Attorney, Agent, or Firm* — Fish & Richardson P.C.

(57) ABSTRACT

A compound heating apparatus includes a microwave generating unit and an infrared radiation generator disposed in a casing outwardly of a heating chamber of the casing. A light shield is disposed around the infrared radiation generator, and has a shield opening facing toward the heating chamber. A microwave blocker plate covers the shield opening. An air supply module is connected to the light shield to blow air to the light shield for causing heat radiant energy generated from the infrared radiation generator to pass acceleratedly by forced heat convection through microwave blocking holes of the microwave block plate to the heating chamber.

10 Claims, 3 Drawing Sheets

(51) Int. Cl.
*H05B 6/76* (2006.01)
*F24C 15/22* (2006.01)
*F24C 15/32* (2006.01)

(58) Field of Classification Search
CPC .... H05B 6/6491; H05B 6/6494; H05B 6/687; H05B 6/704; H05B 6/705; H05B 6/725; H05B 6/74; H05B 6/745; H05B 6/76; H05B 6/766; H05B 3/0076; F24C 15/22; F24C 15/322; F24C 15/325; F24C 15/327
USPC ..... 219/678, 679, 681, 685, 702, 705
See application file for complete search history.

(56) References Cited

U.S. PATENT DOCUMENTS

| | | | | |
|---|---|---|---|---|
| 6,218,651 | B1 * | 4/2001 | Chung | H05B 6/6476 219/681 |
| 2002/0096984 | A1 * | 7/2002 | Konishi | H01K 3/02 313/25 |

FOREIGN PATENT DOCUMENTS

| | | | | |
|---|---|---|---|---|
| CN | 206101432 | U | | 4/2017 |
| KR | 20020042346 | A | * | 6/2002 |
| TW | M563526 | U | | 7/2018 |

* cited by examiner

COMPOUND HEATING APPARATUS

CROSS-REFERENCE TO RELATED APPLICATION

This application claims priority to Taiwanese Patent Application No. 108137001, filed on Oct. 15, 2019.

FIELD

The disclosure relates to a heating apparatus, and more particularly to a compound heating apparatus.

BACKGROUND

It is known to provide a food heating apparatus that has microwave and infrared sources. To avoid the microwave radiation of the microwave source from interfering with or impairing the infrared source, and to collect and distribute heat radiant energy into the heating chamber, a light shield is disposed around the infrared source, and a microwave blocker plate covers an opening of the light shield facing toward the heating chamber. The heat radiant energy generated by the infrared source is collected in an infrared radiation chamber defined by the light shield and the microwave blocker plate, and allowed to pass through holes of the microwave blocker plate into the heating chamber. Meanwhile, the microwave blocker plate can block microwaves from entering the infrared radiation chamber and prevent the microwaves from interfering with or impairing the infrared source.

However, the infrared source has a glass tube (e.g., a quartz or halogen heating tube) to generate high heat radiant energy in a short time. Therefore, the infrared radiant chamber defined by the light shield and the microwave blocker plate can reach an excessively high temperature. In addition, because the microwave blocker plate can block a large amount of the heat radiant energy generated in the infrared radiant chamber, not only is the heat radiation transfer inefficient, but the light shield and the microwave blocker plate are easily deformed and the glass tube can become brittle.

SUMMARY

Therefore, an object of the disclosure is to provide a compound heating apparatus that can alleviate at least one of the drawbacks of the prior art.

According to the disclosure, a compound heating apparatus includes a casing, a microwave generating unit, and an infrared heating unit.

The casing has a heating chamber.

The microwave generating unit is disposed in the casing outwardly of the heating chamber to provide microwaves to the heating chamber.

The infrared heating unit includes at least one infrared radiation generator, at least one light shield, at least one microwave blocker plate, at least one infrared radiation chamber, and an air supply module.

The at least one infrared radiation generator is disposed in the casing outwardly of the heating chamber to generate infrared heat radiation to the heating chamber.

The at least one light shield is disposed around the at least one infrared radiation generator, and has a shield opening facing toward the heating chamber.

The least one microwave blocker plate has a plurality of microwave blocking holes.

The at least one infrared radiation chamber is defined by the at least one microwave blocker plate and the at least one light shield, and encloses the at least one infrared radiation generator.

The air supply module is connected to the at least one light shield to blow air to the at least one light shield for causing heat radiant energy generated from the at least one infrared radiation generator to pass acceleratedly by forced heat convection through the microwave blocking holes to the heating chamber.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
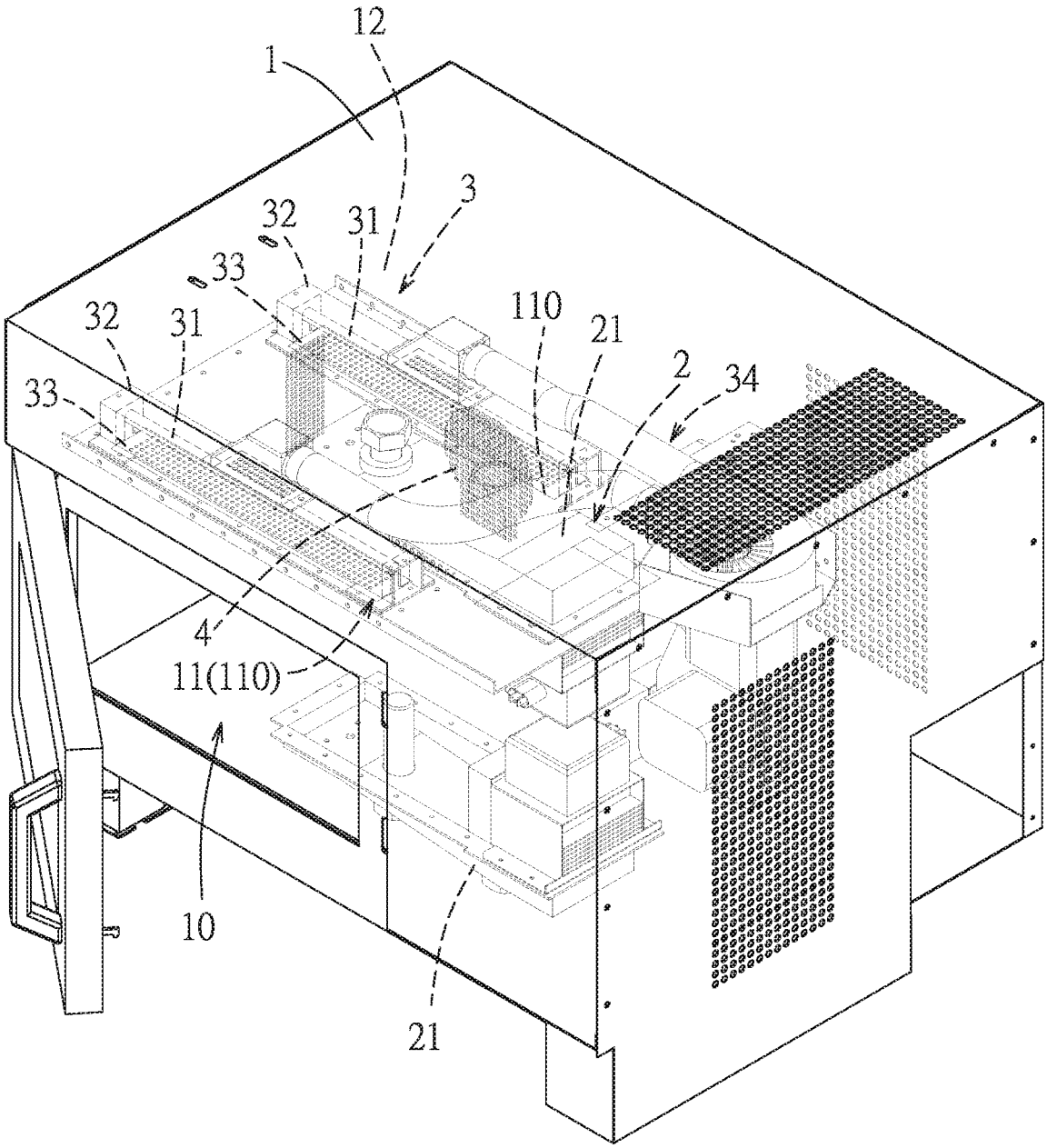
FIG. 1 is a perspective view illustrating a compound heating apparatus according to an embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

FIG. 1 illustrates a compound heating apparatus according to an embodiment of the disclosure. The compound heating apparatus includes a casing 1, a microwave generating unit 2, and an infrared heating unit 3.

The casing 1 has a heating chamber 10, a top space 12 above the heating chamber 10, and a partition structure 11 separating the heating chamber 10 from the top space 12 of the casing 1. The partition structure 11 has two partition openings 110 communicating with the heating chamber 10 and the top space 12 of the casing 1.

The microwave generating unit 2 is disposed in the casing 1 outwardly of the heating chamber 10. In this embodiment, the microwave generating unit 2 includes two microwave generators 21. One of the microwave generators 21 is disposed in the top space 12 of the casing 1. Another microwave generator 21 is disposed below the heating chamber 10. The microwave generators 21 provide microwaves to the heating chamber 10.

Figure 2:
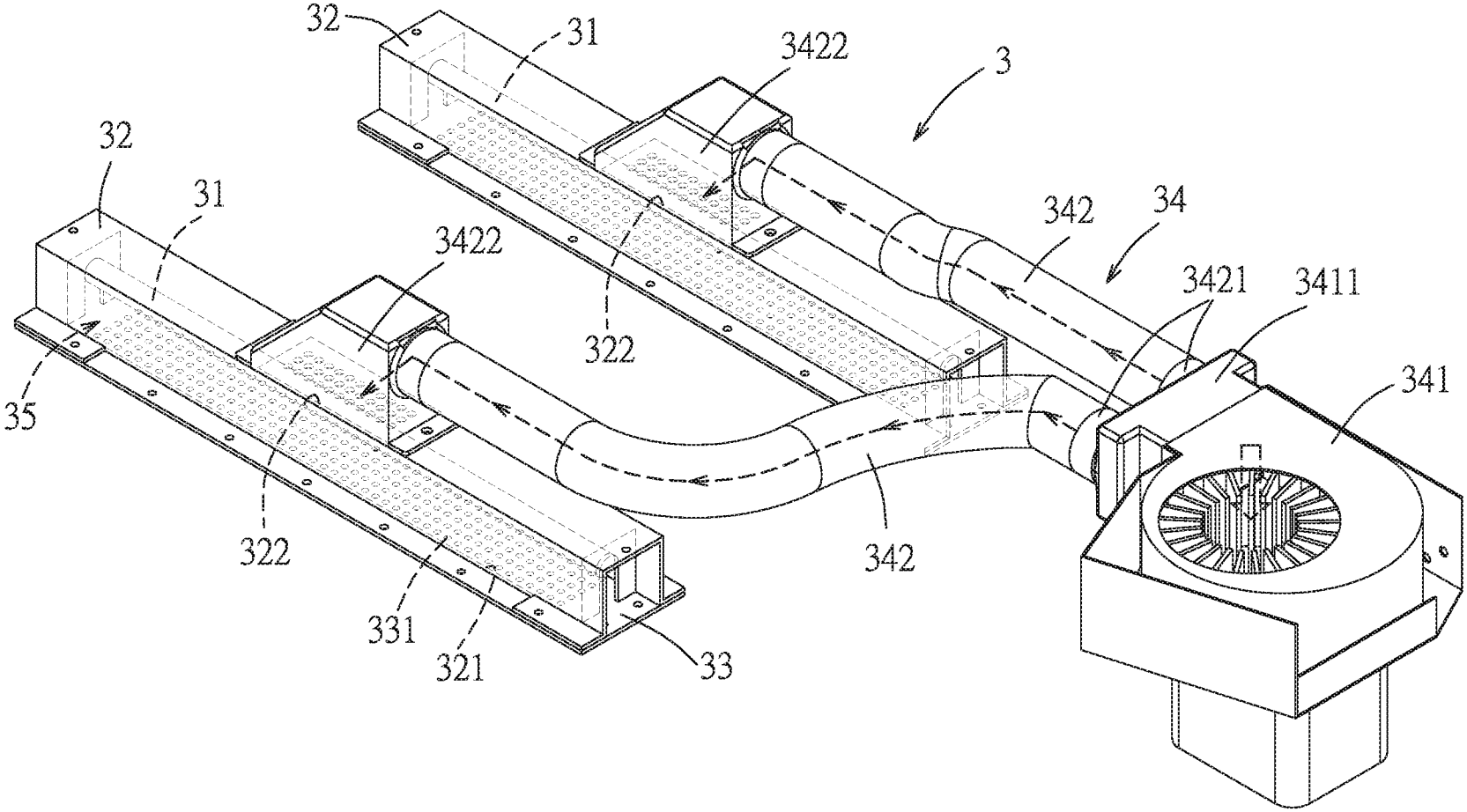
FIG. 2 is a perspective view illustrating an air supply module connected to light shields of the compound heating apparatus.

Referring to FIGS. 1 and 2, the infrared heating unit 3 includes two infrared radiation generators 31, two light shields 32, two microwave blocker plates 33, two infrared radiation chambers 35, and an air supply module 34.

The infrared radiation generators 31 are disposed in the top space 12 of the casing 1. Specifically, the infrared radiation generators 31 are respectively situated above the partition openings 110 and are disposed at two opposite sides of the microwave generator 21 in the top space 12 of the casing 1 to generate infrared heat radiation to the heating chamber 10. In this embodiment, each infrared radiation generator 31 is, but not limited to, a tubular infrared lamp. In other embodiments, each infrared radiation generator 21 can be a quartz lamp, an incandescent lamp, a nickel lamp, or an inert gas (e.g., nitrogen, argon or mixtures thereof) lamp.

The light shields 32 are respectively disposed around the infrared radiation generators 31 within the top space 12 of the casing 1. Each light shield 32 is in an elongate form with an inverted-U cross section. In this embodiment, each light shield 32 has a shield opening 321 and a vent opening 322. The shield opening 321 is aligned with one of the partition openings 110 and faces toward the heating chamber 10. The vent opening 322 is distal from or opposite to the shield opening 321.

Referring to FIG. 2, each microwave blocker plate 33 has a plurality of microwave blocking holes 331, and covers one of the partition openings 110 and the shield opening 321 of one of the light shields 32. Each infrared radiation chamber 35 is defined by one of the microwave blocker plates 33 and one of the light shields 32. The infrared radiation chambers 35 respectively enclose the infrared radiation generators 31. Each light shield 32 communicated with the heating chamber 10 through the microwave blocking holes 331 of the respective microwave blocker plate 33. Each light shield 32 can collect the heat radiant energy generated from the respective infrared radiation generator 31 inside the respective infrared radiation chamber 35. The heat radiant energy collected inside the respective infrared radiation chamber 35 can be transmitted through the microwave holes 331 of the respective microwave blocker plate 33 into the heating chamber 10.

To avoid deformation and structural disintegration caused by the heat radiant energies generated from the infrared radiation generators 31, the light shields 32 and the microwave blocker plates 33 are made of metal. Each of the light shields 32 and the microwave blocker plates 33 has a thickness ranging from 2 mm to 4 mm. The hole dimension of each microwave blocking hole 331 of each microwave blocker plate 33 is smaller than 3 mm. As such, the heat radiant energy inside the infrared radiation chambers 35 can pass through the microwave blocking holes 331, and the microwave blocker plates 33 can prevent the microwaves produced by the microwave generators 21 from entering into the light shields 32 to interfere with or damage the infrared radiation generators 31.

The air supply module 34 is connected to the light shields 32 to blow air to the light shields 32 for causing the heat radiant energy generated from the infrared radiation generators 31 to pass acceleratedly by forced heat convection through the microwave blocking holes 331 of the microwave blocker plates 33 to the heating chamber 10. As shown in FIGS. 1 and 2, the air supply module 34 includes an air blower 341 and two air tubes 342. The air blower 341 is disposed outside of the heating chamber 10 and at one side of both of the light shields 32. The air tubes 342 respectively extend to the light shields 32 from the air blower 341. Each of the air tubes 342 has a first connection end 3421 and a second connection end 3422. The first connection end 3421 of each air tube 342 is connected to an air outlet portion 3411 of the air blower 341. The second connection end 3422 of each air tube 342 is connected to the vent opening 322 of the respective light shield 32. The air blower 341 provides an airflow that passes through the air outlet portion 3411 and the air tubes 342 into the light shields 32 such that the heat radiant energy generated from the infrared radiation generators 31 passes through the microwave blocking holes 331 of the microwave blocker plates 33 to the heating chamber 10 at an accelerated rate via forced heat convection. By this way, an excessively high temperature is avoided in the respective infrared radiant chamber 35 enclosing the respective radiation generator 31, and the transferring efficiency of the heat radiant energy is enhanced. The deformation or structural disintegration of the light shields 32, the microwave blocker plates 33, and the infrared radiation generators 31 due to the excessively high temperatures will not occur.

Figure 3:
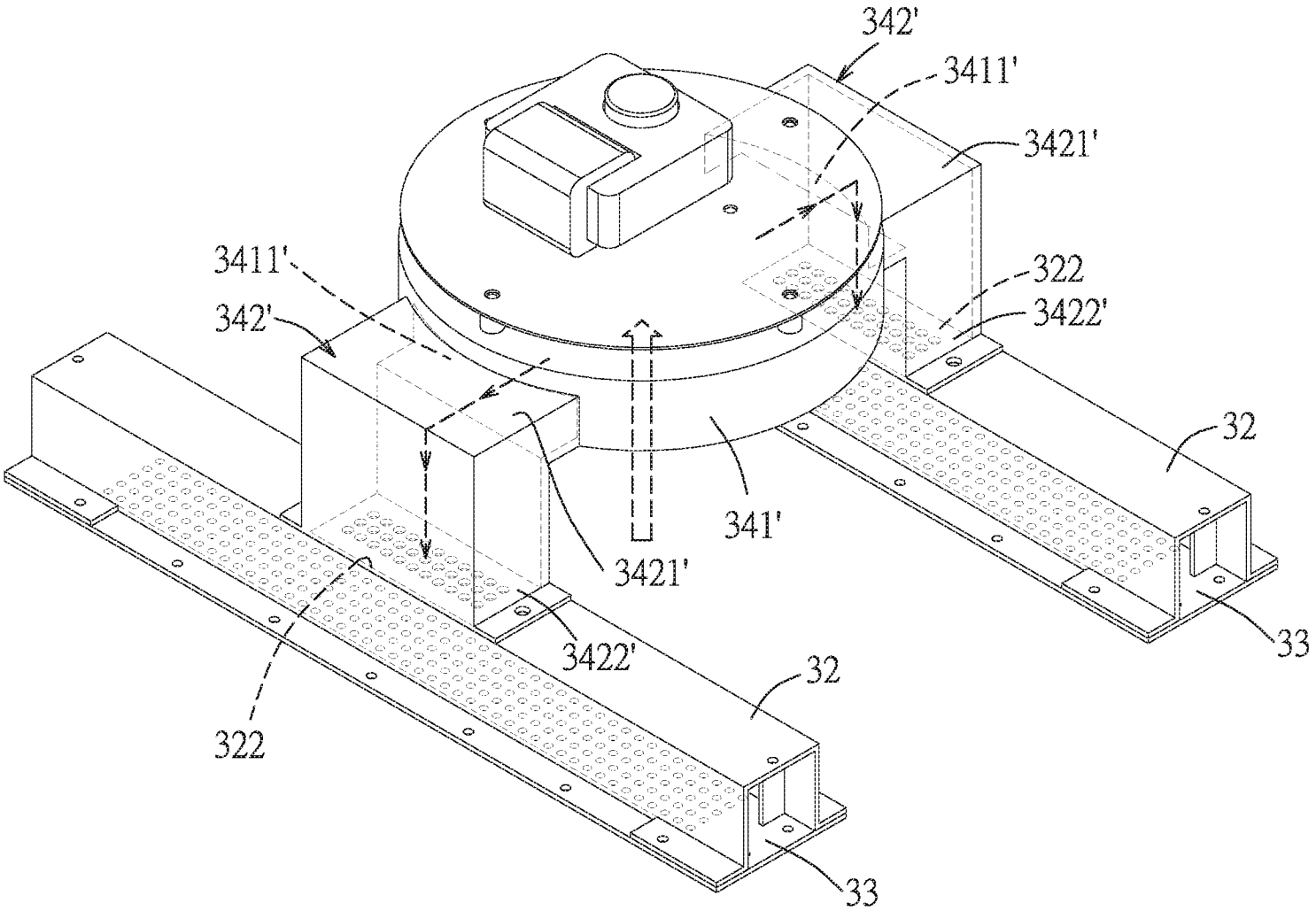
FIG. 3 is a perspective view illustrating a variation of the air supply module used in the embodiment.

FIG. 3 illustrates a variant of the air supply module 34 according to the disclosure. The air blower 341' of the air supply module 34 is disposed above the light shields 32, and the air tubes 342' of the air supply module 34 extend to the light shields 32 downwardly from the air blower 341'. The air blower 341' has two opposite air outlet portions 3411'. Each air tubes 342' has a first connection end 3421' and a second connection end 3422'. The first connection ends 3421' of the air tubes 342' are respectively connected to the air outlet portions 3411' of the air blower 341'. The second end portions 3422' of the air tubes 342' are respectively connected to the vent openings 322 of the light shields 32.

In order to further increase the heat radiation efficiency, each microwave blocker plate 33 has a surface that faces the heating chamber 10 and that is coated with a heat radiating coating, e.g., a high efficiency radiation coating B-600, to radiate heat absorbed by the respective microwave blocker plate 33. Thus, the heat radiant energy of the infrared radiation generators 31 passing through the microwave blocking holes 331 are acceleratedly distributed into the heating chamber 10.

Referring back to FIG. 1, a hot air circulating device 4 is disposed at one side of the casing 1, specifically at a rear side of the casing 1, for circulating hot air inside the heating chamber 10 by heat convention to heat the food (not shown) inside the heating chamber 10. The compound heating apparatus of the disclosure is provided with three heating sources: the microwave generating unit 2, the infrared heating unit 3, and the hot air circulating device 4. In use, the three heating sources may be activated individually, or simultaneously.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A compound heating apparatus, comprising:

a casing having a heating chamber, a top space above said heating chamber, and a partition structure separating said heating chamber from said top space of said casing, said partition structure having two partition openings communicating with said heating chamber and said top space of said casing;

a microwave generating unit disposed in said casing outwardly of said heating chamber to produce microwaves to said heating chamber; and an infrared heating unit including two infrared radiation generators disposed in said top space of said casing to generate infrared heat radiation to said heating chamber, two light shields respectively disposed around said two infrared radiation generators within said top space of said casing, each of said light shields having a shield opening that faces toward said heating chamber and that is aligned with one of said partition openings, and two microwave blocker plates, each of which covers one of said partition openings and said shield opening of one of said light shields, and each of which has a plurality of microwave blocking holes, at least one infrared radiation chamber defined by one of said microwave blocker plates and one of said light shields, and enclosing one of said infrared radiation generators, and an air supply module including an air blower and at least one air tube connected to said one of said light shields to blow air to said one of said light shields for causing heat radiant energy generated from said one of said infrared radiation generators to pass accelerated by forced heat convection through said microwave blocking holes to said heating chamber;

wherein one of said light shields further has a vent opening distal from said shield opening;

wherein said air blower is disposed in said casing and situated outside of said heating chamber, and has an air outlet portion; and wherein said at least one air tube extends into said top space from said air blower and has a first connection end connected to said air outlet portion, and a second connection end connected to said vent opening of said one of said light shields.

2. The compound heating apparatus as claimed in claim 1, wherein said air blower is disposed at one side of said at least one light shield.

3. The compound heating apparatus as claimed in claim 1, wherein said air blower is disposed above said at least one light shield.

4. The compound heating apparatus as claimed in claim 1, wherein each of said light shields has said vent opening opposite to said shield opening;

said at least one air tube includes two air tubes;

said air tubes respectively extend to said light shields from said air blower, each of said air tubes having said first connection end connected to said air outlet portion, and said second connection end connected to said vent opening of said one of said light shields.

5. The compound heating apparatus as claimed in claim 4, wherein said air blower is disposed at one side of both of said light shields.

6. The compound heating apparatus as claimed in claim 4, wherein said air blower is disposed above both of said light shields.

7. The compound heating apparatus as claimed in claim 1, wherein each of said microwave blocker plates has a surface that faces said heating chamber and that is coated with a heat radiating coating to radiate heat absorbed by each of said microwave blocker plates.

8. The compound heating apparatus as claimed in claim 1, further comprising a hot air circulating device disposed at one side of said casing for circulating hot air inside said heating chamber.

9. The compound heating apparatus as claimed in claim 1, wherein each of said infrared radiation generators is a tubular infrared lamp.

10. The compound heating apparatus as claimed in claim 1, further comprising a hot circulating disposed at one side of said casing for circulating hot air in said heating chamber.

* * * * *